US012458187B2

(12) United States Patent
Yang

(10) Patent No.: US 12,458,187 B2
(45) Date of Patent: Nov. 4, 2025

(54) AIR OUTLET STRUCTURE OF VACUUM CLEANER WITH AROMA GENERATION

(71) Applicant: Yu Yang, Shaoyang (CN)

(72) Inventor: Yu Yang, Shaoyang (CN)

( * ) Notice: Subject to any disclaimer, the term of this patent is extended or adjusted under 35 U.S.C. 154(b) by 361 days.

(21) Appl. No.: 18/355,810

(22) Filed: Jul. 20, 2023

(65) Prior Publication Data

US 2024/0398187 A1 Dec. 5, 2024

(30) Foreign Application Priority Data

May 31, 2023 (CN) ..... 202321367314.6

(51) Int. Cl.
*A47L 9/00* (2006.01)
*A47L 9/16* (2006.01)

(52) U.S. Cl.
CPC ..... *A47L 9/0081* (2013.01); *A47L 9/1658* (2013.01)

(58) Field of Classification Search
CPC ..... A47L 7/04; A47L 7/0061; A47L 9/1418; A47L 9/0081; A47L 9/1658; A61L 9/122; A61L 9/12; A61L 9/04; A61L 9/015
USPC ..... 15/246.3
See application file for complete search history.

(56) References Cited

U.S. PATENT DOCUMENTS

| | | | | |
|---|---|---|---|---|
| 1,989,868 | A * | 2/1935 | Kessler | A47L 7/04 15/DIG. 8 |
| 2,302,548 | A * | 11/1942 | Heuberger | A47L 7/04 15/257.1 |
| 2,759,228 | A * | 8/1956 | Gordon | A47L 7/04 55/505 |
| 6,511,548 | B1 * | 1/2003 | Oreck | A47L 9/00 422/5 |
| 7,774,897 | B2 * | 8/2010 | Oh | A47L 7/04 15/327.2 |
| 9,801,970 | B2 * | 10/2017 | Chase | A61L 9/12 |
| 2012/0227208 | A1 * | 9/2012 | Bosses | A47L 9/00 15/323 |
| 2016/0302631 | A1 * | 10/2016 | Guerra | A47L 7/04 |
| 2023/0043567 | A1 * | 2/2023 | Copeland | A61L 9/12 |

* cited by examiner

*Primary Examiner* — Bryan R Muller
(74) *Attorney, Agent, or Firm* — HOWARD M COHN and Associates, LLC

(57) ABSTRACT

An air outlet structure of a vacuum cleaner with aroma generation includes an air duct, an airflow generating device, an air filtering device, and an aroma sheet. The airflow generating device is configured to generate airflow in the air duct, and the air filtering device and the aroma sheet are disposed in the air duct. The air filtering device is disposed at one end of each of air outlets of the air duct, and the air filtering device divides the air duct into an inner air duct and an outer air duct. The airflow flows from the inner air duct to the outer air duct under an action of the airflow generating device, and the aroma sheet is disposed in the air duct.

7 Claims, 5 Drawing Sheets

AIR OUTLET STRUCTURE OF VACUUM CLEANER WITH AROMA GENERATION

TECHNICAL FIELD

The present disclosure relates to a technical field of dust removal devices, and in particular to an air outlet of a vacuum cleaner with aroma generation.

BACKGROUND

Vacuum cleaners are one kind of common cleaning apparatus, which are capable of generating powerful suction and may suck up dust or other foreign matters. The vacuum cleaners each generally includes a dust collecting cylinder for accommodating the dust or the other foreign matters, an air duct communicated with an accommodating space in the dust collecting cylinder, and a fan for generating airflow in the air duct. However, when the vacuum cleaners are used for a long time, the dust or the other foreign matters accumulated inside easily generate peculiar smells, and the peculiar smells may follow the airflow and dissipate outwards through an air outlet of the air duct, thereby affecting user experience when the vacuum cleaners are in use.

Therefore, it is necessary provide an air outlet structure of a vacuum cleaner with aroma generation to improve smells of air coming out of the air outlet.

SUMMARY

Based on above defects in the prior art, the present disclosure aims to provide an air outlet structure of a vacuum cleaner with aroma generation for improving smells of air coming out of an air outlet.

According to embodiments of the present disclosure, the present disclosure provides an air outlet structure of a vacuum cleaner with aroma generation, including an air duct, an airflow generating device, an air filtering device, and an aroma sheet. The airflow generating device is configured to generate airflow in the air duct, and the air filtering device and the aroma sheet are disposed in the air duct. The air filtering device is disposed at one end of each of air outlets of the air duct, and the air filtering device divides the air duct into an inner air duct and an outer air duct. The airflow flows from the inner air duct to the outer air duct under an action of the airflow generating device, and the aroma sheet is disposed in the inner air duct.

Furthermore, the air outlet structure of the vacuum cleaner with aroma generation further includes an inner cover, the inner cover is fixed in the inner air duct, and the aroma sheet is detachably disposed on the inner cover.

Furthermore, the air outlet structure of the vacuum cleaner with aroma generation further includes an outer cover, the air outlets of the air duct extend along a circumferential direction on an outer periphery of the outer cover, and a plurality of first air ports are defined on an outer periphery of the inner cover along the circumferential direction.

Furthermore, the aroma sheet is disposed on an outer end surface of the inner cover; the inner cover further includes first limiting components and a second limiting component, the first limiting components are fixed on the outer end surface, the second limiting component is movably disposed on the outer end surface, and the first limiting components and the second limiting component limit the aroma sheet to slide on the outer end surface.

Furthermore, each of the first limiting components includes a first limiting portion and a second limiting portion, the second limiting portion is connected to the outer end surface and the first limiting portion. The aroma sheet is located between the first limiting portion and the outer end surface, the first limiting portion limits the aroma sheet to move in a direction distal from the outer end surface, and the second limiting portion limits the aroma sheet to slide on the outer end surface.

Furthermore, second air ports are defined on the outer end surface and respectively face the first limiting portion of each of the first limiting components. The aroma sheet and the second limiting portion are spaced apart, so that the airflow flows out through the second air ports.

Furthermore, an inner contour of the second limiting portion is matched with an outer contour of the aroma sheet.

Furthermore, the second limiting component includes an elastic arm, the elastic arm is located on the outer end surface. A third air port is defined on the outer end surface, and the third air port surrounds the elastic arm, so as to rotatably connect the elastic arm to the outer end surface.

Furthermore, the second limiting component further includes a third limiting portion. The elastic arm includes a connecting end, the connecting end is connected to the outer end surface. The third limiting portion is located at one end of the connecting end distal from the elastic arm, and the third limiting portion is configured to limit the aroma sheet to slide on the outer end surface.

The present disclosure has beneficial effects as following.

The air filtering device divides the air duct into the inner air duct and the outer air duct, and the aroma sheet is disposed in the inner air duct, so that the airflow drives fragrance of the aroma sheet to enter the outer air duct, and diffuses the fragrance of the aroma sheet through the air outlets of the air duct, thereby improving smells of the air. In addition, since a flow rate of the airflow in the inner air duct is faster than a flow rate of the airflow in the outer air duct, efficiency of diffusing the fragrance of the aroma sheet is better.

Figure 1:
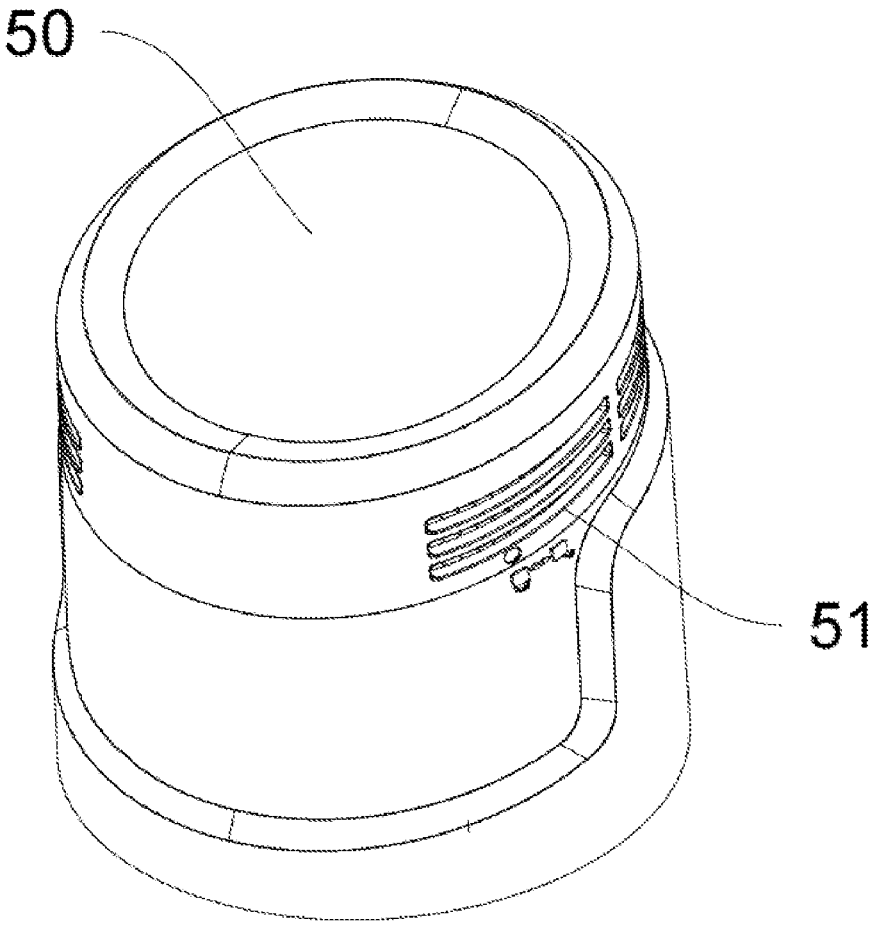
FIG. 1 is a schematic diagram of an outer portion of an air outlet structure of a vacuum cleaner with aroma generation according to one embodiment of the present disclosure.

Reference numerals in the drawings: 10. air filtering device; 20. aroma sheet; 30. air duct; 31. outer air duct; 32. inner air duct; 40. inner cover; 41. first air port; 42. outer end surface; 421. second air port; 422. third air port; 43. first limiting component; 431. first limiting portion; 432. second limiting portion; 44. second limiting component; 41. elastic arm; 442. third limiting portion; 443. connecting end; 50.

outer cover; 51. air outlet; 52. first annular groove; 60. mounting bracket; 61. second annular groove; 70. airflow generating device.

DETAILED DESCRIPTION

In order to enable those who skilled in the art to better understand technical solutions in the present disclosure, the technical solutions in embodiments of the present disclosure are clearly and completely described below with reference to accompanying drawings in the embodiments of the present disclosure. All other embodiments obtained by those who skilled in the art based on the embodiments of the present disclosure without creative efforts shall fall within protection scopes of the present disclosure.

It should be noted that when an element is referred to as being "fixed to" or "disposed on" another component, it may be directly or indirectly disposed on another component; when one component is referred to as being "connected to" another component, it may be directly connected to another component or indirectly connected to another component.

It should be understood that orientations or positional relationships indicated by terms "length", "width", "upper", "lower", "front", "rear", "left", "right", "vertical", "horizontal", "perpendicular", "top", "bottom", "inner", "outer", etc. are based on the orientations or positional relationships shown in the drawings, rather than indicating or implying that an indicated device or component must have a particular orientation, constructed and operated in a particular orientation, and therefore cannot be understood as a limitation to the present disclosure.

In addition, terms "first" and "second" are used for descriptive purposes only and cannot be understood as indicating or implying relative importance or implicitly indicating a number of indicated technical features. Thus, features defined with "first" and "second" may explicitly or implicitly include one or more of the features. In the description of the present disclosure, "multiple" and "a plurality of" mean two or more, unless specifically defined otherwise.

It is apparent that structures, proportions, sizes, etc. shown in the drawings of the present specification are only used to cooperate with contents disclosed in the present specification, so as to be understood and read by those who skilled in the art, and are not intended to limit limiting conditions that may be implemented by the present disclosure, and therefore do not have any technical substantive significance. Any modifications to the structures, changes in proportion relationships, or adjustments in the sizes, without affecting effectiveness and objectives that can be achieved in the present disclosure, should still fall within the scopes of technical contents disclosed in the present disclosure.

Please refer to FIGS. 1-5, one embodiment of the present disclosure provides an air outlet structure of a vacuum cleaner with aroma generation, the air outlet structure of the vacuum cleaner with aroma generation includes an air duct 30, an airflow generating device 70, and a dust collecting cylinder. The airflow generating device 70 is configured to generate airflow in the air duct 30, the airflow generating device 70 may be a common fan, and an accommodating space in the dust collecting cylinder is communicated with the air duct 30 for accommodating dust or other foreign matter. The air outlet structure of the vacuum cleaner with aroma generation further includes an air filtering device 10 for filtering air and an aroma sheet 20 for improving smells, and the air filtering device 10 and the aroma sheet 20 are both disposed in the air duct 30.

Specifically, the air filtering device 10 is disposed at one end of each of air outlets 51 of the air duct 30, and the air filtering device 10 divides the air duct 30 into an inner air duct 32 and an outer air duct 31. The airflow flows from the inner air duct 32 to the outer air duct 31 under an action of the airflow generating device 70, and the aroma sheet 20 is disposed in the inner air duct 32. The airflow in the outer air duct 31 is filtered by the air filtering device 10, and a flow rate of the airflow in the outer air duct 31 is lower than a flow rate of the airflow in the inner air duct 32, so that disposing the aroma sheet 20 in the inner air duct 32 enables a better efficiency of diffusing the smells.

It should be noted that the aroma sheet 20 in the embodiment is solid and may be naturally volatilized in air, and is not needed for additional heating or auxiliary volatilization of electric appliances. The air filtering device 10 may be a high efficiency particulate air (HEPA) filtering device or a filtering cotton, and in the embodiment, the air filtering device 10 is preferably the HEPA filtering device.

More specifically, the aroma sheet 20 may be disposed at any position between an inner space of the air filtering device 10 and the dust collecting cylinder.

In one embodiment, the air outlet structure of the vacuum cleaner with aroma generation further includes an inner cover 40, the inner cover 40 is fixed in the inner air duct 32, and the aroma sheet 20 is detachably disposed on the inner cover 40, so that users may replace the aroma sheet 20.

In one embodiment, the air outlet structure of the vacuum cleaner with aroma generation further includes an outer cover 50, the air outlets 51 of the air duct 30 extend along a circumferential direction on an outer periphery of the outer cover 50, and a plurality of first air ports 41 are defined on an outer periphery of the inner cover 40 along the circumferential direction. In the embodiment, the air outlets 51 and the plurality of the first air ports 41 defined on a respective peripheral side are relatively smooth in convection, and when the vacuum cleaner with aroma generation works, the airflow may not directly rush to the users.

In one embodiment, in order to detachably mount the aroma sheet 20, first limiting components 43 and a second limiting component 44 are further disposed on the inner cover 40. The first limiting components 43 are fixed on the outer end surface 42, the second limiting component 44 is movably disposed on the outer end surface 42, and the first limiting components 43 and the second limiting component 44 limit the aroma sheet 20 to slide on the outer end surface 42.

Specifically, each of the first limiting components 43 includes a first limiting portion 431 and a second limiting portion 432, the second limiting portion 432 is connected to the outer end surface 42 and the first limiting portion 431. The aroma sheet 20 is located between the first limiting portion 431 and the outer end surface 42, the first limiting portion 431 limits the aroma sheet 20 to move in a direction distal from the outer end surface 42, and the second limiting portion 432 is capable of limiting the aroma sheet 20 to slide on the outer end surface 42.

In one embodiment, second air ports 421 are defined on the outer end surface 42 and respectively face the first limiting portion 431 of each of the first limiting components 43. The aroma sheet 20 and the second limiting portion 432 are spaced apart, so that the airflow flows out through the second air ports 421, the airflow passes through a periphery of the aroma sheet 20, which enables fragrance to be better diffused.

In one embodiment, an inner contour of the second limiting portion 432 is matched with an outer contour of the aroma sheet 20, which is beneficial for mounting the aroma sheet 20. For example, when the aroma sheet 20 is square, an inner side of the second limiting portion 432 may be configured as one or two planes, and when the aroma sheet 20 is circular, the inner side of the second limiting portion 432 may be configured as an adapted curved surface.

In a specific embodiment, the aroma sheet 20 is preferably circular, and the first limiting portion 431, the second limiting portion 432, and the second air ports 421 are all arc-shaped, so that the airflow may be better guided outwards.

Certainly, in other embodiments, the aroma sheet 20 may also be square or other shapes, which is not limited herein.

Figure 4:
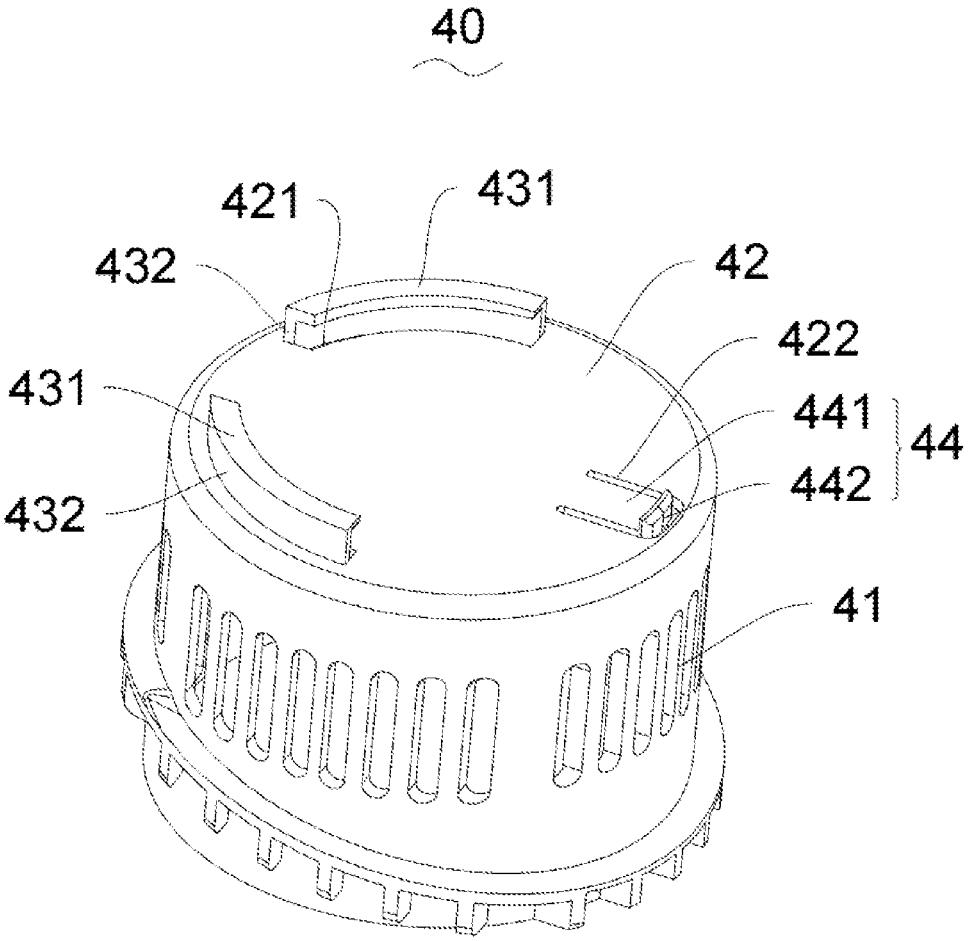
FIG. 4 is a structural schematic diagram of an inner cover of the air outlet structure of the vacuum cleaner with aroma generation according to one embodiment of the present disclosure.
Figure 5:
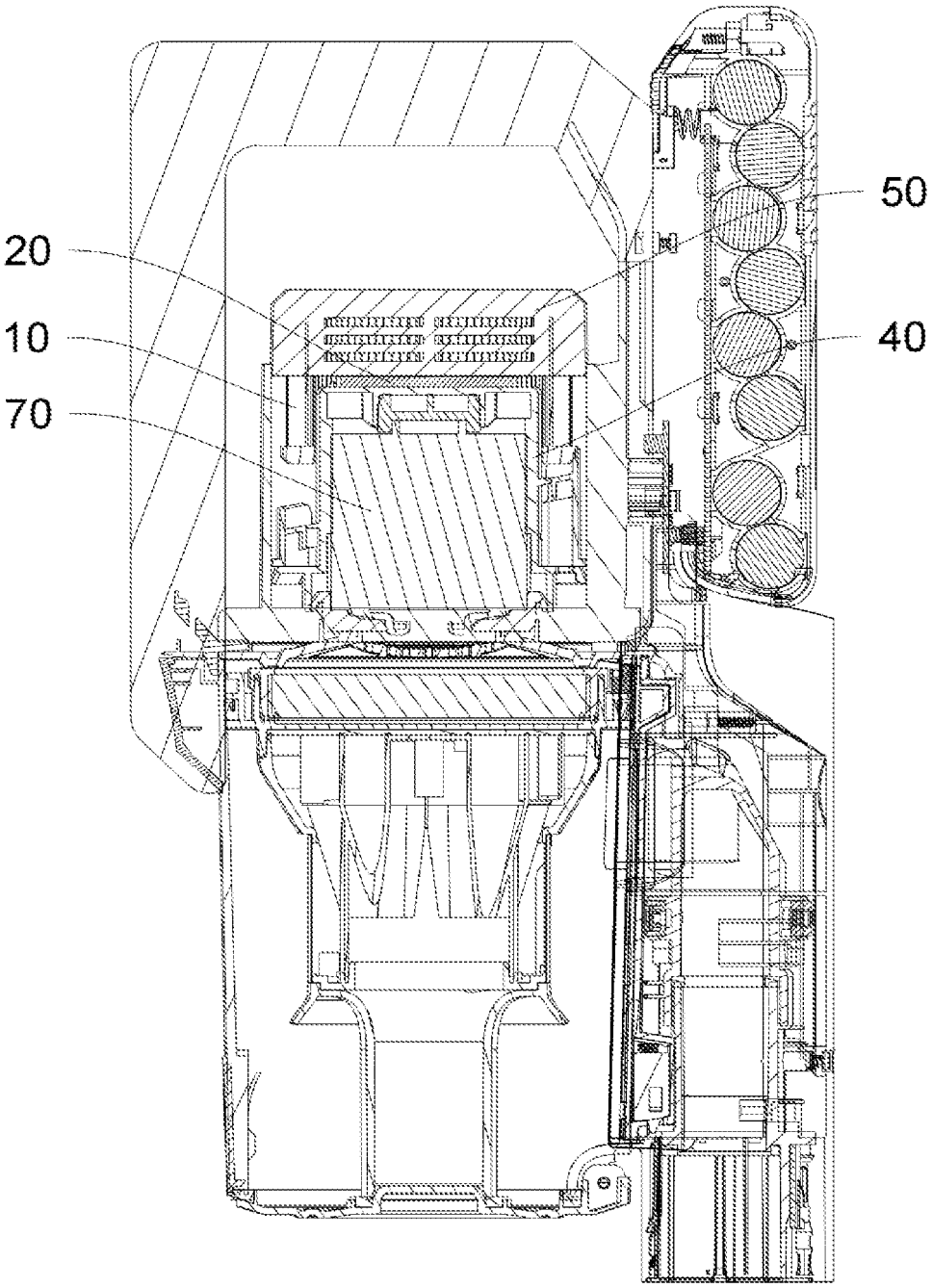
FIG. 5 is a cross-sectional schematic diagram of the vacuum cleaner with aroma generation according to one embodiment of the present disclosure.

In one embodiment, referring to FIG. 4, the second limiting component 44 includes an elastic arm 441, the elastic arm 441 is located on the outer end surface 42. A third air port 422 is defined on the outer end surface 42, and the third air port 422 surrounds the elastic arm 441, so as to rotatably connect the elastic arm 441 to the outer end surface 42.

Specifically, the second limiting component 44 further includes a third limiting portion 442. The elastic arm 441 includes a connecting end 443, the connecting end 443 is connected to the outer end surface 42. The third limiting portion 442 is located at one end of the connecting end 443 distal from the elastic arm 441, and the third limiting portion 442 is configured to limit the aroma sheet 20 to slide on the outer end surface 42.

In the embodiment, the users may press down the elastic arm 441, so that the aroma sheet 20 may be plugged into a space between the first limiting portion 431 and the outer end surface 42, and when the elastic arm 441 rebounds, the aroma sheet 20 may be limited between the second limiting portion 432 and the third limiting portion 442, and large shaking may not be generated when the vacuum cleaner with aroma generation is used. Similarly, the users may take out the aroma sheet 20 through pressing the third limiting portion 442.

Figure 2:
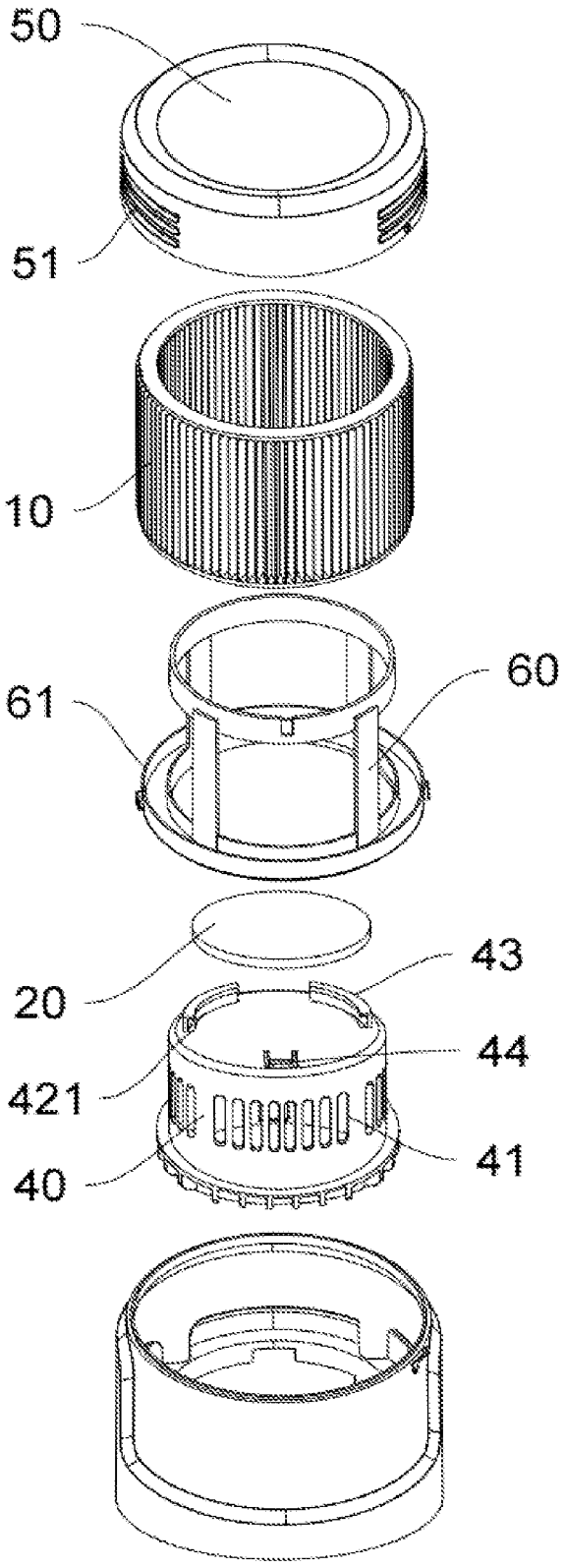
FIG. 2 is an exploded structural schematic diagram of the air outlet structure of the vacuum cleaner with aroma generation according to one embodiment of the present disclosure.
Figure 3:
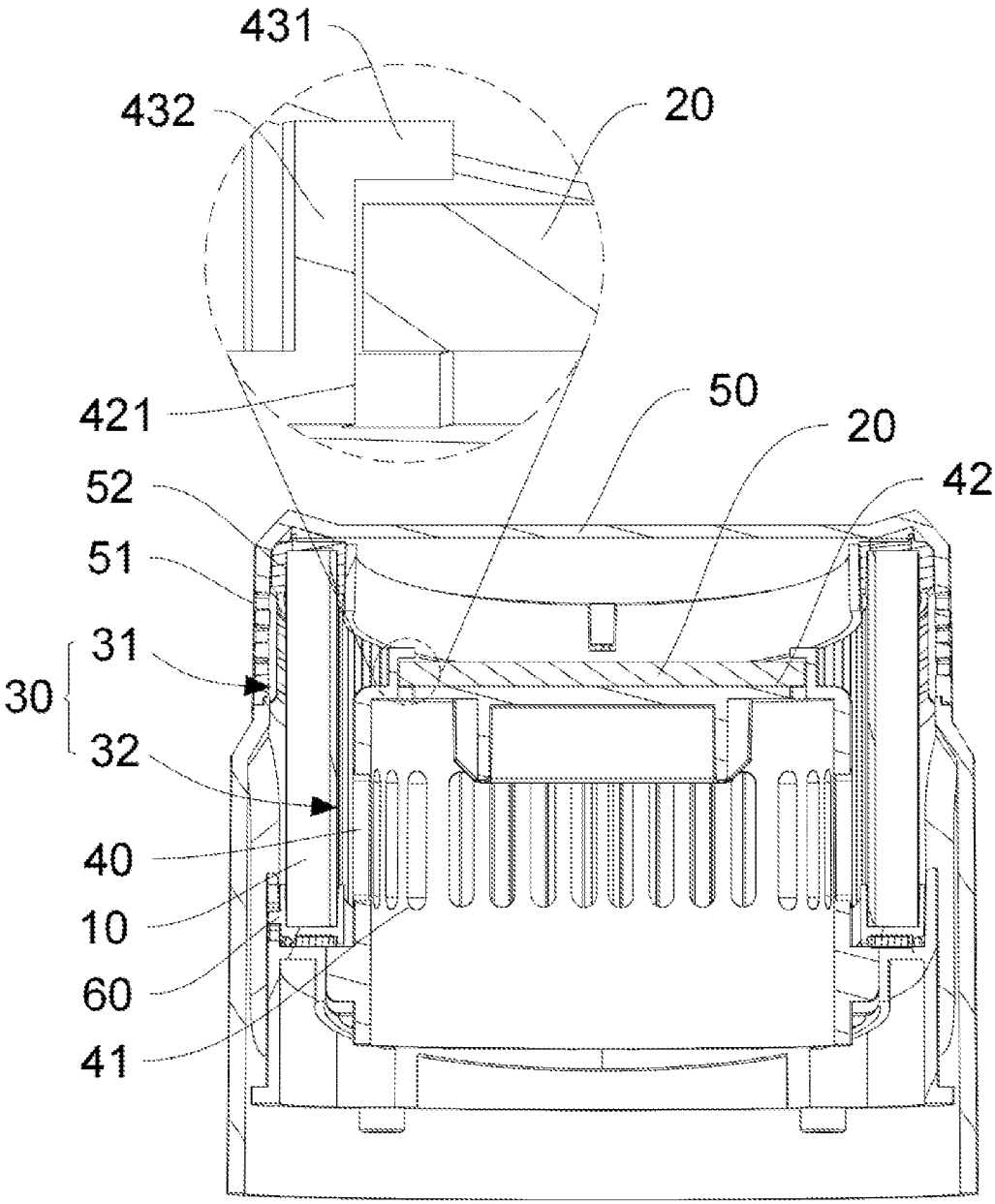
FIG. 3 is a cross-sectional schematic diagram of the air outlet structure of the vacuum cleaner with aroma generation according to one embodiment of the present disclosure.

In one embodiment, referring to FIGS. 2 and 3, a first annular groove 52 is defined on an inner periphery of the outer cover 50, and the air outlet structure of the vacuum cleaner with aroma generation further includes a mounting bracket 60, the mounting bracket 60 is fixed on the outer periphery of the inner cover 40. A second annular groove 61 is defined on the mounting bracket 60, a first end of the air filtering device 10 is mounted in the first annular groove 52, and a second end of the air filtering device 10 is mounted in the second annular groove 61. Certainly, there may be multiple mounting manners of the air filtering device 10, which are not limited herein.

Thus, the air filtering device 10 divides the air duct 30 into the inner air duct 32 and the outer air duct 31, and the aroma sheet 20 is disposed in the inner air duct 32, so that the airflow drives the fragrance of the aroma sheet 20 to enter the outer air duct 31, and diffuses the fragrance of the aroma sheet 20 through the air outlets 51 of the air duct 30, thereby improving smells of the air. In addition, since the flow rate of the airflow in the inner air duct 32 is faster than the flow rate of the airflow in the outer air duct 31, efficiency of diffusing the fragrance of the aroma sheet 20 is better.

Above description of the disclosed embodiments enables those who skilled in the art to implement or use the present disclosure. Various modifications to these embodiments may be apparent to those who skilled in the art, and general principles defined herein may be implemented in other embodiments without departing from spirits or scopes of the present disclosure. Therefore, the present disclosure may not be limited to these embodiments shown herein, but is to be accorded the widest scopes consistent with principles and novel features disclosed herein.

What is claimed is:

1. An air outlet structure of a vacuum cleaner with aroma generation, comprising:

an air duct;

an airflow generating device;

an air filtering device; and an aroma sheet;

wherein the airflow generating device is configured to generate airflow in the air duct, and the air filtering device and the aroma sheet are disposed in the air duct; the air filtering device is disposed at a downstream end of the air duct adjacent to a plurality of air outlets of the air duct, and the air filtering device divides the air duct into an inner air duct and an outer air duct; the airflow flows from the inner air duct to the outer air duct under an action of the airflow generating device; and the aroma sheet is disposed in the inner air duct;

wherein the air outlet structure of the vacuum cleaner with aroma generation further comprises an inner cover defining:

an inlet of the inner air duct, an internal space defining part of the inner duct and an external surface downstream from the internal surface, wherein the inner cover is fixed in the inner air duct, and the aroma sheet is detachably disposed on an external end surface of the inner cover, and the inner cover further comprises first limiting components and a second limiting component, the first limiting components are fixed on the outer end surface, the second limiting component is movably disposed on the outer end surface, and the first limiting components and the second limiting component limit the aroma sheet to slide on the outer end surface.

2. The air outlet structure of the vacuum cleaner with aroma generation according to claim 1, wherein the air outlet structure of the vacuum cleaner with aroma generation further comprises an outer cover, the plurality of air outlets of the air duct extend along a circumferential direction on an outer periphery of the outer cover, and a plurality of first air ports are defined on an outer periphery of the inner cover along the circumferential direction.

3. The air outlet structure of the vacuum cleaner with aroma generation according to claim 1, wherein each of the first limiting components comprises a first limiting portion and a second limiting portion, the second limiting portion is connected to the outer end surface and the first limiting portion; the aroma sheet is located between the first limiting portion and the outer end surface, the first limiting portion limits the aroma sheet to move in a direction distal from the outer end surface, and the second limiting portion limits the aroma sheet to slide on the outer end surface.

4. The air outlet structure of the vacuum cleaner with aroma generation according to claim 3, wherein second air ports are defined on the outer end surface and respectively face the first limiting portion of each of the first limiting components; the aroma sheet and the second limiting portion are spaced apart, so that the airflow flows out through the second air ports.

5. The air outlet structure of the vacuum cleaner with aroma generation according to claim 4, wherein an inner contour of the second limiting portion is matched with an outer contour of the aroma sheet.

6. The air outlet structure of the vacuum cleaner with aroma generation according to claim 3, wherein the second limiting component comprises an elastic arm, the elastic arm is located on the outer end surface; a third air port is defined on the outer end surface, and the third air port surrounds the elastic arm, so as to flexibly connect the elastic arm to the outer end surface.

7. The air outlet structure of the vacuum cleaner with aroma generation according to claim 6, wherein the second limiting component further comprises a third limiting portion; the elastic arm comprises a connecting end, the connecting end is connected to the outer end surface; the third limiting portion is located at one end of the elastic arm distal from the connecting end, and the third limiting portion is configured to limit the aroma sheet to slide on the outer end surface.

* * * * *